US007521161B2

(12) United States Patent
Kinoshita

(10) Patent No.: US 7,521,161 B2
(45) Date of Patent: Apr. 21, 2009

(54) ELECTROPHOTOGRAPHIC PHOTORECEPTOR, UNDERCOAT LAYER COATING LIQUID THEREFOR, AND IMAGE FORMING APPARATUS AND PROCESS CARTRIDGE USING THE PHOTORECEPTOR

(75) Inventor: Takehiko Kinoshita, Mishima (JP)

(73) Assignee: Ricoh Company, Ltd., Tokyo (JP)

( * ) Notice: Subject to any disclaimer, the term of this patent is extended or adjusted under 35 U.S.C. 154(b) by 500 days.

(21) Appl. No.: 11/003,597

(22) Filed: Dec. 6, 2004

(65) Prior Publication Data

US 2005/0123846 A1 Jun. 9, 2005

(30) Foreign Application Priority Data

Dec. 5, 2003 (JP) ..... 2003-407365

(51) Int. Cl.
*G03G 5/14* (2006.01)

(52) U.S. Cl. ..... 430/60; 430/64; 399/159; 399/111

(58) Field of Classification Search ..... 430/60, 430/64
See application file for complete search history.

(56) References Cited

U.S. PATENT DOCUMENTS 4,575,527 A * 3/1986 Dixon et al. ..... 524/253
4,946,766 A 8/1990 Fukagai
5,079,117 A * 1/1992 Koyama et al. ..... 430/59.6
5,643,702 A 7/1997 Yu
6,026,262 A 2/2000 Kinoshita et al.
2002/0150832 A1 10/2002 Kinoshita et al.
2005/0112484 A1 * 5/2005 Nozoe et al. ..... 430/60

FOREIGN PATENT DOCUMENTS

EP 0 394 142 A2 10/1990
EP 0 490 622 A1 6/1992
EP 0 498 626 A1 8/1992
JP 2567090 11/1990
JP 2608328 1/1991
JP 2637557 1/1991
JP 5-158267 6/1993
JP 5-257312 10/1993
JP 2004177552 A * 6/2004

OTHER PUBLICATIONS

Diamond, Arthur S & David Weiss (eds.) Handbook of Imaging Materials, 2nd ed. New York: Marcel-Dekker, Inc. (Nov. 2001) pp. 145-164.*
Alger, Mark S.M. Polymer Science Dictionary. London: Elsevier Applied Science. (1989) "Alkyd Resin" p. 13.*
Alger, Mark S. Polymer Science Dictionary. London: Elsevier Applied Sceince (1989) p. 225.*
Derwent Publications, AN 2004-333404, XP-002314208, JP 2003-342045, Dec. 3, 2003.
Derwent Publications, AN 1989-314207, XP-002314209, JP 01-233459, Sep. 19, 1989.

* cited by examiner

*Primary Examiner*—Christopher RoDee
(74) *Attorney, Agent, or Firm*—Oblon, Spivak, McClelland, Maier & Neustadt, P.C.

(57) ABSTRACT

An electrophotographic photoreceptor, including an electroconductive substrate; an undercoat layer located overlying the electroconductive substrate; and a photosensitive layer located overlying the undercoat layer, wherein the undercoat layer comprises a blocked isocyanate compound and a basic amine.

9 Claims, 2 Drawing Sheets

ELECTROPHOTOGRAPHIC PHOTORECEPTOR, UNDERCOAT LAYER COATING LIQUID THEREFOR, AND IMAGE FORMING APPARATUS AND PROCESS CARTRIDGE USING THE PHOTORECEPTOR

BACKGROUND OF THE INVENTION

1. Field of the Invention

The present invention relates to an electrophotographic photoreceptor for use in laser printers, digital copiers and laser facsimiles; an undercoat layer coating liquid therefor; a method of preparing the photoreceptor; and image forming apparatus and a process cartridge using the photoreceptor.

2. Discussion of the Background

Electrophotographic image forming devices can produce high-quality images at a high-speed, and are used for copiers and laser beam printers. An organic photoreceptor using an organic photoconductive material has been developed and has gradually become widely used as a photoreceptor in electrophotographic image forming devices. Over time, the photoreceptor has changed from a) a charge transporting complex constitution or a single-layered constitution wherein a charge generation material is dispersed in a binder resin to b) a functionally-separated constitution wherein a photosensitive layer is separated into charge generation layer and a charge transport layer, and has improved its performance. The currently prevailing approach includes use of a functionally-separated photoreceptor having a constitution wherein an undercoat layer is formed on an aluminum substrate, a charge generation layer is formed on the undercoat layer and a charge transport layer is formed on the charge generation layer.

In conventional systems, the undercoat layer is formed to improve adhesiveness, coatability, chargeability of the photosensitive layer, and to prevent an unnecessary charge from the substrate from entering the photosensitive layer and cover a defect on the substrate. The undercoat layer typically includes only a binder resin and an undercoat layer including a binder resin and a pigment. Specific examples of resins used in the undercoat layer include water-soluble resins such as polyvinylalcohol and casein; alcohol-soluble resins such as nylon copolymers; and hardened resins having a three-dimensional network such as polyurethane, melamine resins, phenol resins, phenol resins, oil-free alkyd resins, epoxy resins and siloxane resins.

Although water-soluble resins are inexpensive and have good properties, a solvent for a photosensitive layer coating liquid dissolves the water-soluble resins and frequently deteriorates a coatability of the undercoat layer. Nylon alcohol-soluble resins are highly sensitive to environment because of their high water absorbability and affinity, and therefore the resultant photoreceptor changes its properties according to humidity. In an atmosphere of high humidity, a photoreceptor having an undercoat layer using alcohol-soluble resins, particularly the nylon resins, absorb a large amount of water in the undercoat layer, and therefore properties thereof change significantly when repeatedly used in an environment of high temperature and high humidity or a low temperature and low humidity. This results in production of abnormal images such as black spots and deterioration of image density. It is well known that an inorganic pigment such as titanium oxide may be dispersed in the undercoat layer to enhance a hiding effect of the defect on the substrate and a scattering effect of incident light such as coherence light (a laser beam) to prevent occurrence of an interference pattern. However, the above-mentioned deficiency in the face of humidity does not change even when the inorganic pigment is mixed with the nylon resins.

Among hardened resins having a three-dimensional network, a large amount of formaldehyde is used to form melamine resins, alkyd/melamine resins, acryl/melamine resins, phenol resins and methoxymethylated nylon. Therefore, unreacted materials are absorbed in the resins and the formaldehyde generates in a heat cross-linking process after the undercoat layer is formed. However, formaldehyde is an indoor pollutant listed in the Clean Air Act and is said to be a cause of an illness known as "sick house syndrome." Thus, to prevent formaldehyde from being discharged to the atmosphere, expensive collection equipment needs to be used.

Therefore, there exists a demand for a less environmentally-damaging heat-crosslinking resin for use an undercoat layer, where the resin does not generate formaldehyde when hardened with heat.

Specific examples of such resins include urethane resins. To harden the urethane resins, a compound, including a group including an active hydrogen such as acrylpolyol, is dried with hot air for a predetermined period of time in the presence of a hardener, such as a monomer including an isocyanate group, such that a three-dimensional network crosslinking reaction between the group including an active hydrogen of the acrylpolyol and isocyanate group of the hardener starts to form a hardened film. However, since the isocyanate group has a high reactivity, a coating liquid using the isocyanate group has a short usable time. Therefore, a blocked isocyanate having a long pot life in a coating liquid for an electrophotographic photoreceptor and an isocyanate coating material, which is stable in the presence of alcohol-soluble chemicals, water-soluble chemicals or the compound including a group including an active hydrogen, is a topic of ongoing research.

The blocked isocyanate includes an isocyanate group protected with a blocker such as oxime and starts an addition reaction with a compound, including a group including active hydrogen such as a hydroxyl group, when heated and the blocker is removed to proceed a crosslinking reaction.

Since the blocker has a high release temperature, an investment for a drying equipment increases more than a conventional equipment, which consumes more energy than the conventional one and increases $CO_2$, resulting in increase of global warming.

Namely, it is desired that the release temperature, i.e., the crosslinking temperature, is decreased and a usable time of a coating liquid for the photoreceptor is extended to the maximum.

Japanese Laid-Open Patent Publications Nos. 06-158267 and 06-257312, and Japanese Patents Nos. 02637557, 02608328 and 02567090 disclose a photoreceptor including block isocyanate in its intermediate or undercoat layer, wherein a zinc compound and a basic compound are disclosed as a catalyst.

However, a basic amine in the present invention not only largely reduces the crosslinking temperature, but also when included in an undercoat layer of an electrophotographic photoreceptor, the resultant photoreceptor has high potential stability and produces no abnormal images. In addition, the basic amine provides an undercoat layer coating liquid for an electrophotographic photoreceptor, having high liquid properties, which makes a clear distinction from the above-mentioned zinc compound and basic compound.

Because of these reasons, a need exists for a coating liquid for an electrophotographic photoreceptor having good electrostatic properties and high durability, having good storage stability and capable of reducing crosslinking energy, and a method of preparing the photoreceptor.

SUMMARY OF THE INVENTION

Accordingly, an object of the present invention is to provide an electrophotographic photoreceptor having good electrostatic properties and high durability.

Another object of the present invention is to provide a coating liquid for the photoreceptor, having good storage stability and capable of reducing crosslinking energy.

A further object of the present invention is to provide a method of preparing the photoreceptor.

These objects and other objects of the present invention, either individually or collectively, have been satisfied by the discovery of an electrophotographic photoreceptor including an electroconductive substrate; an undercoat layer located overlying the electroconductive substrate; and a photosensitive layer located overlying the undercoat layer, wherein the undercoat layer comprises a blocked isocyanate compound and a basic amine.

It is preferable that the undercoat layer further includes an oil-free alkyd resin including a hydroxyl group.

Further, the undercoat layer preferably includes the basic amine in an amount of from 0.0001 to 5% by weight based on total weight of the oil-free alkyd resin and blocked isocyanate compound.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features and attendant advantages of the present invention will be more fully appreciated as the same becomes better understood from the detailed description when considered in connection with the accompanying drawings in which like reference characters designate like corresponding parts throughout and wherein.

DETAILED DESCRIPTION OF THE INVENTION

Generally, the present invention provides an electrophotographic photoreceptor without deterioration of chargeability and sensitivity, an image forming apparatus using the photoreceptor, an undercoat layer coating liquid reducing cost of facility investment and energy consumption in a heat crosslinking process, and a method of preparing an electrophotographic photoreceptor using the undercoat layer coating liquid.

Figure 1:
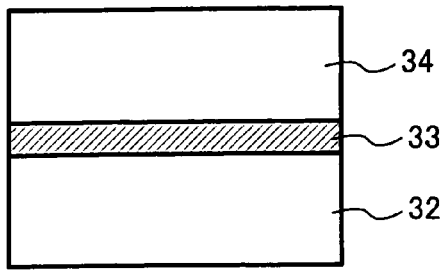
FIG. 1 is a cross-sectional view of an embodiment of layers of the electrophotographic photoreceptor of the present invention.

FIG. 1 is a cross-sectional view of an embodiment of layers of the electrophotographic photoreceptor of the present invention, wherein at least an undercoat layer 33 and a photosensitive layer 34 are overlaid on an electroconductive substrate 32.

Figure 2:
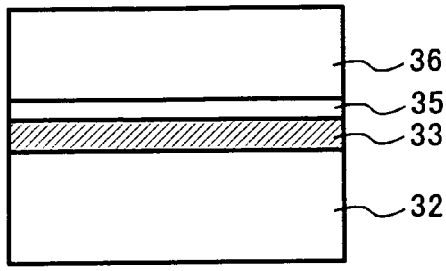
FIG. 2 is a cross-sectional view of another embodiment of layers of the electrophotographic photoreceptor of the present invention.

FIG. 2 is a cross-sectional view of another embodiment of layers of the electrophotographic photoreceptor of the present invention, wherein an undercoat layer 33, a charge generation layer 35 and a charge transport layer 36 are overlaid on an electroconductive substrate 32.

The undercoat layer 33 includes at least a blocked isocyanate resin. When an electrophotographic photoreceptor is formed, the storage stability of a liquid formed of a solvent wherein an isocyanate resin and a pigment are dispersed is essential. Therefore, the isocyanate is preferably blocked with a blocker or inner blocked when stored in an environment of high temperature and high humidity or for long periods.

Specific examples of the blocked isocyanate resin include IPDI-B1065 and IPDI-B1530 which are brand names of isophorondiisocyanate using E-caprolactam as a blocker from Degussa-Huls AG or IPDI-BF1540 which is a brand name of inner blocked urethodione bonding type block isophorondiisocyanate from HULS, and oxime-blocked 2,4-trilenediisocyanate, 2,6-trilenediisocyanate, diphenylmethane-4,4'-diisocyanate, hexamethylenediisocyanate, etc.

Specific examples of the oxime include formaldehyde oxime, acetoaldo oxime, methyl ethyl ketone oxime and cyclohexanone oxime. Specific examples of the oxime-blocked blocked isocyanate include DM-60 and DM-160 which are brand names from Meisei Chemical Works, Ltd. and Burnock B7-887-60, B3-867 and DB980K from Dainippon Ink And Chemicals, Inc.

The undercoat layer 33 includes a basic amine.

The basic amine includes an aliphatic amine, an aromatic amine and an alicyclicamine. Specific examples of the aliphatic amine include ammonia; monoethanol amine; diethanol amine; triethanol amine; polymethylene diamine such as ethylene diamine, diamine butane, diamine propane, hexane diamine and dodecane diamine; polyethylene polyamine such as diethylene triamine and triethylene tetramine; polyether diamine; etc.

Specific examples of the aromatic amine include 2,4- or 2,6-diaminotoluene (TDA), crude TDA, 1,2-, 1,3- or 1,4-phenylene diamine, diethyltrilene diamine, 4,4-diaminodiphenylmethane (MDA), crude MDA, 1,5-naphthylene diamine, 3,3'-dichloro-4,4'-diaminodiphenylmethane, 3,3'-dimethyl-4,4'-diaminodiphenylcyclohexane, 1,2-, 1,3- or 1,4-xylene diamine, etc.

Specific examples of the alicyclic amine include 4,4'-diaminodicyclohexylmethane, 3,3'-dimethyl-4,4'-diaminodicyclohexylmethane, 3-amino-1-cyclohexylaminoppropane, bis(aminomethyl)cyclohexane, isophoronediamine, norbornenediamine, 3,9-bis(3-aminopropyl)-2,4,8,10-tetraoxaspiro(−5,5-)undecane, etc.

In addition, N,N, N,N-tetramethylhexamethylenediamine, N,N, N,N-tetramethylpropylenediamine, N,N, N,N, N-pentamethyldiethylenetriamine, N,N, N,N-tetramethylethylenediamine, N-methyl-N'-dimethylaminoethylpiperazine N,N-dimethylaminocyclohexylamine, bis(dimethylaminoethyl) ether, Tris(N,N-dimethylaminopropyl)hexahydro-S-triazine, methylmorpholine, ethylmorpholine, triethylenediamine, 1-methylimidazole, 1,2-dimegthylimidazole, 1-isobutyl-2-methylimidazole can also be used.

The amine compound includes at least one of —$NH_2$ group and —NH— group, and has an average molecular weight not less than 110, preferably from 120 to 5,000, and more preferably from 120 to 500. It is essential that the undercoat layer 33 includes the amine compound in an amount of from 0.0001 to 5% by weight, and preferably from 0.01 to 1% by weight based on total weight of a base resin (a) and a hardener (b). When the amount is less than 0.0001% by weight, the crosslinking temperature, i.e., the release temperature of the blocker scarcely changes. Therefore, the resultant photoreceptor has a high residual potential and a low photosensitivity from the beginning because of including a large amount of an unreacted crosslinker or the base resin in its undercoat layer. An image forming apparatus including such a photoreceptor produces images having low image density, and which is noticeable when continuously used. When the amount is greater than 5% by weight, the resultant undercoat layer coating liquid has a shorter usable time. In addition, since the excessive basic materials excessively prevents a charge injection after generated by irradiation in the resultant photoreceptor, the residual potential thereof noticeably increases. The basic amine compounds can be used alone or in combination with a tertiary amino alcohol.

Specific examples of the base resin included in the undercoat layer include resins including an active hydrogen such as polyether polyol, polyester polyol, acrylic polyol, epoxy polyol which are typically called as polyol; an oil-free alkyd resin; an epoxy resin; etc. Particularly, the oil-free alkyd resin including at least a hydroxyl group is preferably used.

The oil-free alkyd resin is a saturated polyester resin formed of a polybasic acid and a polyalcohol, and has a direct chain structure bonded with an ester bonding without a fatty acid. The oil-free alkyd resin has innumerable kinds according to the polybasic acid, polyalcohol and a modifying agent. Specific examples of the oil-free alkyd resin including a hydroxyl group include Bekkolite M-6401-50, M-6402-50, M-6003-60, M-6005-60, 46-118, 46-119, 52-584, M-6154-50, M-6301-45, 55-530, 54-707, 46-169-S, M-6201-40-1M, M-6205-50, 54-409 which are brand names of oil-free alkyd resins from Dainippon Ink And Chemicals, Inc.; and Espel 103, 110, 124 and 135 which are brand names of oil-free alkyd resins from Hitachi Chemical Co., Ltd.

The oil-free alkyd resin preferably has a hydroxyl value not less than 60. When less than 60, the crosslinking is not sufficiently performed because the binder resin has less reactive site with the isocyanate and the layer formability deteriorates, resulting in deterioration of adherence between a photosensitive layer and an electroconductive substrate. When greater than 150, a moisture resistance of the resultant photoreceptor deteriorates if an unreacted functional group remains, and tends to accumulate a charge in an environment of high humidity, resulting in extreme deterioration of photosensitivity thereof, image density due to increase of a dark part potential and halftone image reproducibility. The hydroxyl value is determined by a method specified in JIS K 0070.

The oil-free alkyd resin including a hydroxyl group included in the undercoat layer preferably has an equal number of moles of the hydroxyl group to that of the isocyanate group of the blocked isocyanate resin included therein. When the hydroxyl group or isocyanate group which is a reactive group performing a crosslink between the oil-free alkyd resin including a hydroxyl group and the blocked isocyanate resin is excessively present and remains as unreacted, the unreacted group in the undercoat layer accumulates a charge.

The undercoat layer 33 may include a metal oxide as a white pigment.

Specific examples of the metal oxide include a titanium oxide, an aluminum oxide, a zinc oxide, a lead white, a silicon oxide, an indium oxide, a zirconium oxide, a magnesium oxide, etc., wherein the aluminum oxide, zirconium oxide or titanium oxide is preferably used.

The titanium oxide is white, absorbing little visible light and near-infrared light, and preferably used to increase sensitivity of a photoreceptor. In addition, the titaniumoxide has a large refractive index and can effectively prevent moire occurring when images are written with coherent light such as a laser beam.

The titanium oxide preferably has a purity not less than 99.4%. Impurities thereof are mostly hygroscopic materials such as $Na_2O$ and $K_2O$, and ionic materials. When the purity is less than 99.2%, properties of the resultant photoreceptor largely change due to the environment (particularly to the humidity) and repeated use. Further, the impurities tend to cause defective images such as black spots. In the present invention, the purity of the titanium oxide in the undercoat layer can be determined by a measurement method specified in JIS K5116, the entire contents of which are incorporated by reference.

Further, a ratio (P/R) of a titanium oxide (P) to a binder resin (R) included in the under coat layer is preferably from 0.9/1.0 to 2.5/1.0 by volume. The P/R is less than 0.9/1.0, properties of the undercoat layer are contingent to those of the binder resin, and particularly properties of the resultant photoreceptor largely changes due to a change of the temperature and humidity and repeated use. When the P/R is greater than 2.0/1.0, the undercoat layer includes more airspaces and deteriorates its adherence to a charge generation layer. Further, when the P/R is greater than 3.0/1.0, air is stored therein, which causes an air bubble when a photosensitive layer is coated and dried, resulting in defective coating.

Specific examples of the solvent for use in a coating liquid for the undercoat layer 33 include isopropanol, acetone, methyl ethyl ketone, cyclohexanone, tetrahydrofuran, dioxane, ethylcellosolve, ethyl acetate, methyl acetate, dichloromethane, monochlorobenzene, cyclohexane, toluene, xylene, ligroin, etc.

An inorganic pigment, i.e., the titanium oxide included in the undercoat layer 33 preferably has a particle diameter of from 0.05 to 1 μm, and more preferably from 0.1 to 0.5 μm. In the present invention, the undercoat layer preferably has a thickness of from 0.1 to 50 μm, and more preferably of from 2 to 8 μm. When the undercoat layer has a thickness less than 2 μm, the undercoat layer does not sufficiently work as an undercoat layer and the resultant photoreceptor has insufficient pre-exposure resistance. When the undercoat layer has a thickness greater than 8 μm, the layer has less smoothness, and the resultant photoreceptor has less sensitivity and environment resistance, although having sufficient pre-exposure resistance.

Next, the electroconductive substrate and photosensitive layer will be explained.

Suitable materials as the electroconductive substrate 32 include materials having a volume resistance not greater than $10^{10}$ Ω·cm. Specific examples of such materials include plastic cylinders, plastic films or paper sheets, on the surface of which a metal such as aluminum, nickel, chromium, nichrome, copper, gold, silver, platinum and the like, or a metal oxide such as tin oxides, indium oxides and the like, is deposited or sputtered. In addition, a plate of a metal such as aluminum, aluminum alloys, nickel and stainless steel and a metal cylinder, which is prepared by tubing a metal such as the metals mentioned above by a method such as drawing ironing, impact ironing, extruded ironing and extruded drawing, and then treating the surface of the tube by cutting, super finishing, polishing and the like treatments, can also be used as the substrate. In addition, the endless nickel belt and endless stainless belt disclosed in Japanese Laid-Open Patent Publication No. 52-36016 can also be used as the electroconductive substrate 32.

Further, an electroconductive powder dispersed in a proper binder resin can be coated on the above-mentioned substrate 32. Specific examples of the electroconductive powder include carbon powders such as carbon black and acetylene black; metallic powders such as aluminium, nickel, iron, nichrome, copper, zinc, and silver; or metallic oxides such as electroconductive titanium oxide, electroconductive tin oxide and ITO. Specific examples of the binder resins include thermoplastic resins, thermosetting resins or photo-curing resins such as polystyrene, styrene-acrylonitrile copolymers, styrene-butadiene copolymers, styrene-maleic anhydride copolymers, polyester, polyvinyl chloride, vinyl chloride-vinyl acetate copolymers, polyvinyl acetate, polyvinylidene chloride, polyarylate, polycarbonate, cellulose acetate resins, ethyl cellulose resins, polyvinyl butyral, polyvinyl formal, polyvinyl toluene, acrylic resins, silicone resins, fluorine-containing resins, epoxy resins, melamine resins, urethane resins, phenolic resins and alkyd resins. Such an electroconductive layer can be formed by coating a liquid wherein the electroconductive powder and binder resin are dispersed in a proper solvent such as tetrahydrofuran, dichloromethane, 2-butanone and toluene.

Further, a cylindrical substrate having an electroconductive layer formed of a heat contraction tube including a material such as polyvinylchloride, polypropylene, polyester, polystyrene, polyvinylidene, polyethylene, rubber chloride and Teflon (registered trade name) and the above-mentioned an electroconductive powder thereon can also be used as the electroconductive substrate 32.

The charge generation layer 35 includes a butyral resin as a binder resin in an amount of 50% by weight in Examples of the present invention. However, polyamide, polyurethane, epoxy resins, polyketone, polycarbonate, silicone resins, acrylic resins, polyvinyl formal, polyvinyl ketone, polystyrene, polyvinylcarbazole, polyacrylamide, polyvinylbenzal, polyester, phenoxy resins, vinylchloride-vinylacetate copolymers, polyvinylacetate, polyamide, polyvinylpyridine, cellulose resins, casein, polyvinylalcohol, polyvinylpyrrolidone, etc. can optionally be used together.

The charge generation layer preferably includes the binder resin in an amount of from 10 to 500 parts by weight, and more preferably from 25 to 300 parts per 100 parts by weight of the charge generation material.

Specific examples of the solvent for use in a coating liquid for the charge generation layer include isopropanol, acetone, methyl ethyl ketone, cyclohexanone, tetrahydrofuran, dioxane, ethylcellosolve, ethyl acetate, methyl acetate, dichloromethane, monochlorobenzene, cyclohexane, toluene, xylene, ligroin, etc. The charge generation layer 35 is formed by coating a liquid wherein the charge generation material and binder resin are dispersed in a solvent on the undercoat layer 33, and drying the liquid.

The charge generation layer preferably has a thickness of from 0.01 to 5 μm, and more preferably of from 0.1 to 2 μm.

The charge transport layer 36 can be formed on the charge generation layer by coating a coating liquid wherein a charge transport material and a binder resin is dissolved or dispersed in a proper solvent thereon, and drying the liquid. In addition, the charge transport layer may optionally include a plasticizer, a leveling agent and an antioxidant. Specific examples of the solvent include chloroform, tetrahydrofuran, dioxane, toluene, monochlorobenzene, dichloroethane, dichloromethane, cyclohexanone, methyl ethyl ketone, acetone, etc.

The charge transport materials included in the charge transport layer include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds.

Specific examples of the positive-hole transport materials include known materials such as poly-N-carbazole and its derivatives, poly-γ-carbazolylethylglutamate and its derivatives, pyrene-formaldehyde condensation products and their derivatives, polyvinyl pyrene, polyvinyl phenanthrene, polysilane, oxazole derivatives, oxadiazole derivatives, imidazole derivatives, monoarylamines, diarylamines, triarylamines, stilbene derivatives, α-phenyl stilbene derivatives, benzidine derivatives, diarylmethanederivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, other polymerized hole transport materials, and the like.

Specific examples of the binder resin for use in the charge transport layer include thermoplastic resins or thermosetting resins such as polystyrene, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyral resins, polyvinyl formal resins, polyvinyl toluene, poly-N-vinyl carbazole, acrylic resins, silicone resins, epoxy resins, melamine resins, urethane resins, phenolic resins, alkyd resins and the polycarbonate copolymers disclosed in Japanese Laid-Open Patent Publications Nos. 5-15.8250 and 6-51544.

The charge transport layer preferably includes the charge transport material of from 20 to 300 parts by weight, and more preferably from 40 to 150 parts by weight per 100 parts by weight of the binder resin. The charge transport layer preferably has a thickness of from 5 to 50 μm.

In the present invention, the charge transport layer may include a leveling agent and an antioxidant. Specific examples of the leveling agents include silicone oils such as dimethyl silicone oils and methylphenyl silicone oils; and polymers and oligomers having a perfluoroalkyl group in their side chain. A content of the leveling agent is from 0 to 1 part by weight per 100 parts by weight of the binder resin. Specific examples of the antioxidant include hindered phenolic compounds, sulfur compounds, phosphorous compounds, hindered amine compounds, pyridine derivatives, piperidine derivatives, morpholine derivatives, etc. The charge transport layer preferably includes the antioxidant of from 0 to 5 parts by weight per 100 parts by weight of the binder resin.

Coating methods for the electrophotographic photoreceptor include dip coating methods, spray coating methods, bead coating methods, nozzle coating methods, spinner coating methods, ring coating methods, Meyer bar coating methods, roller coating methods, curtain coating methods, etc.

Figure 3:
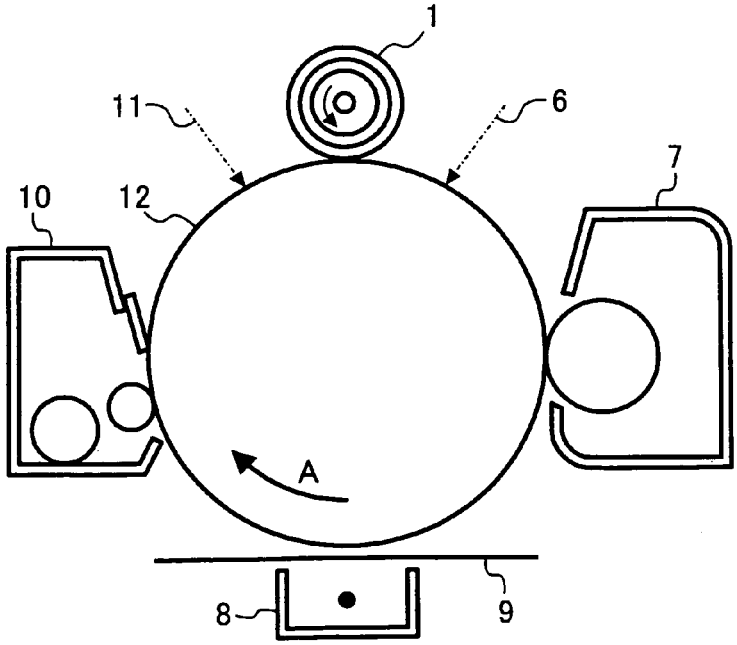
FIG. 3 is a schematic view illustrating a partial cross-section of an embodiment of the electrophotographic image forming apparatus of the present invention.

As shown in FIG. 3, in an electrophotographic image forming apparatus equipped with the electrophotographic photoreceptor of the present invention, a peripheral surface of the electrophotographic photoreceptor 12 rotating in the direction of an arrow A is positively or negatively charged by a charger 1 to have a predetermined voltage. A DC voltage is applied to the charger 1. The DC voltage applied thereto is preferably from −2,000 to +2,000 V.

In addition to the DC voltage, a pulsating flow voltage which is further overlapped with an AC voltage may be applied to the charger 1. The AC voltage overlapped with the DC voltage preferably has a voltage between peaks not greater than 4,000 V. However, when the AC voltage is overlapped with the DC voltage, the charger and electrophotographic photoreceptor vibrate to occasionally emit an abnormal noise. Therefore, it is preferable that the applied voltage is gradually increased to protect the photoreceptor.

Besides indirect chargers such as scorotron and corotron chargers, a direct charger preventing an oxidizing gas is suggested.

The charger 1 can rotate in the same or reverse direction of the photoreceptor 12, or can slide on a peripheral surface thereof without rotating. Further, the charger may have a cleaning function to remove a residual toner on the photoreceptor 12. In this case, a cleaner 10 is not required.

The charged photoreceptor 12 receives imagewise light 6 (slit light or laser beam scanning light) from an irradiator (not shown). When the photoreceptor is irradiated, the irradiation is shut down for a non-image part of an original and a image part thereof having a low potential by the irradiation receives a developing bias slightly lower than the surface potential to perform a reversal development. Thus, an electrostatic latent image correlating to the original including the non-image part is sequentially formed.

The electrostatic latent image is developed by an image developer 7 with a toner to form a toner image. The toner image is sequentially transferred by a transferer 8 onto a recording material 9 fed from a paper feeder (not shown) between the photoreceptor 12 and transferer 8 in synchronization with the rotation of the photoreceptor 12. The recording material 9 having the toner image is separated from the photoreceptor and transferred to an image fixer (not shown) such that the toner image is fixed thereon to form a copy which is fed out from the image forming apparatus.

The surface of the photoreceptor 12 is cleaned by the cleaner 10 removing a residual toner after transferred, discharged by a pre-irradiation 11 and prepared for forming a following image.

The above-mentioned image forming unit may be fixedly set in a copier, a facsimile or a printer. However, the image forming unit may be detachably set therein as a process cartridge which is an image forming unit (or device) including a photoreceptor, and at least one of a charger, an image developer and a cleaner.

Figure 4:
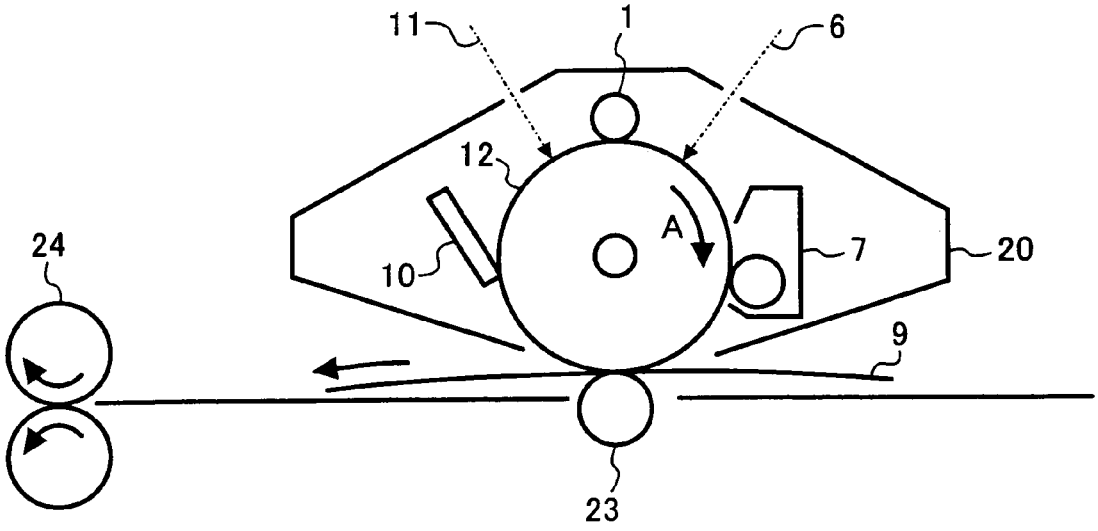
FIG. 4 is a schematic view illustrating a cross-section of an embodiment of the process cartridge of the present invention.

For instance, as shown in FIG. 4, at least a photoreceptor 12, a charger 1 and an image developer 7 are included in a container 20 as a unit for an electrophotographic image forming apparatus, and the apparatus unit may be detachable with the apparatus using guide means thereof such as a rail. A cleaner 10 may not be included in the container 20.

Figure 5:
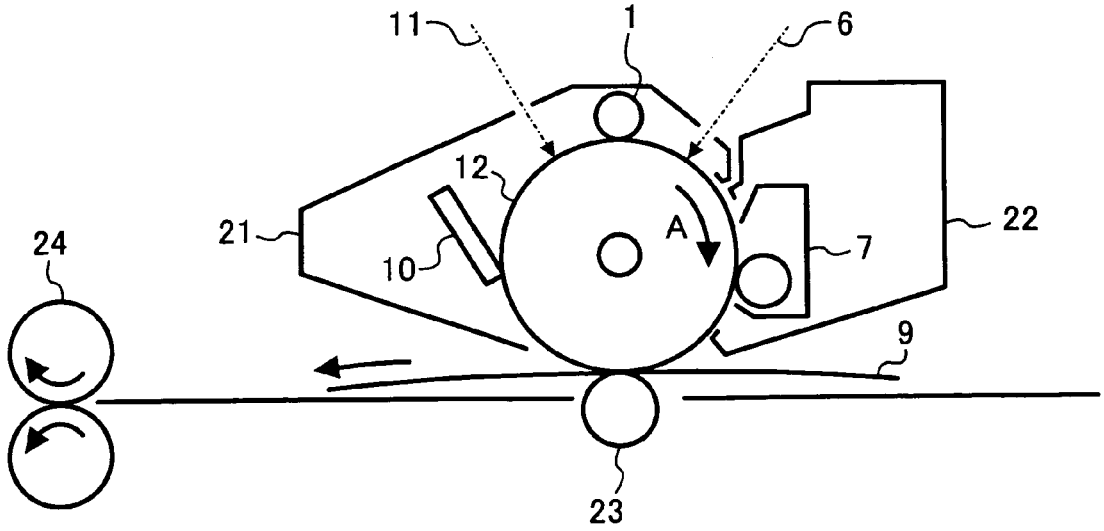
FIG. 5 is a schematic view illustrating a cross-section of another embodiment of the process cartridge of the present invention.

Further, as shown in FIG. 5, at least a photoreceptor 12 and a charger 1 are included in a first container 21 as a first unit and at least an image developer 7 is included in a second container 22 as a second unit, and the first and second unit may detachable with the apparatus. A cleaner 10 may not be included in the container 21.

As a transferer 23 in FIGS. 4 and 5, a transferer having the same configuration as that of the charger 1 can be used. A DC voltage of from 400 to 2,000 V is preferably applied to the transferer 23. Numeral 24 is a fixer.

Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

Preparation of an Undercoat Layer Coating Liquid and a Coating Method Thereof

The following materials were mixed and dispersed in a ball mill for 72 hrs to prepare an undercoat layer coating liquid.

| | |
|---|---|
| Titanium oxide (CREL from Ishihara Sangyo Kaisha, Ltd.) | 80 |
| Oil-free alkyd resin (Bekkolite M6163-60 having a solid content of 60% by weight from Dainippon Ink & Chemicals, Inc.) | 15 |
| Blocked isocyanate resin (Burnock B3-867 having a solid content of 70% by weight from Dainippon Ink and Chemicals, Inc.) | 20 |
| Methyl ethyl ketone | 100 |
| Diethylamine | 0.23 |

The undercoat layer coating liquid was coated on three (3) aluminum drums having a diameter of 30 mm and a length of 340 mm, and the liquid coated on each drum was dried at 110° C., 130° C. and 150° C. for 20 min respectively to form an undercoat layers having a thickness of 4 μm thereon.

Preparation of a Charge Generation Layer Coating Liquid and a Coating Method Thereof The following materials were mixed and dispersed in a ball mill for 216 hrs to prepare a dispersion.

| | |
|---|---|
| τ-type metal-free phthalocyanine (TPA-891 from Toyo Ink Mfg. Co., Ltd.) | 12 |
| Disazo pigment having the following formula (1) | 24 |
| Cyclohexanone | 330 |

(1)

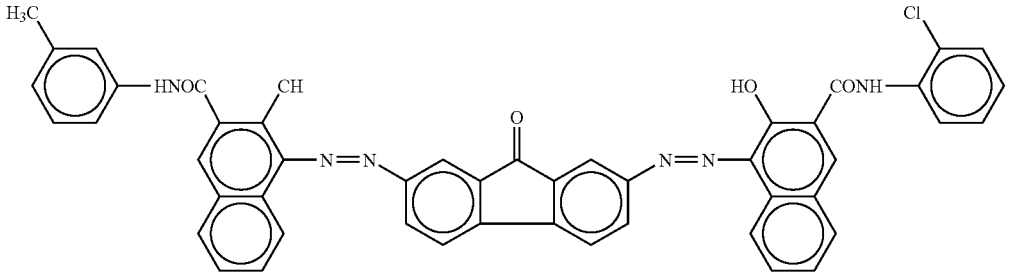

Then, a resin solution wherein 6 parts by weight of polyvinylbutyral (XYHL from Union Carbide Corp.) are dissolved in 850 parts by weight of methyl ethyl ketone and 1,100 parts by weight of cyclohexanone was added to the dispersion, and the dispersion was further dispersed for 3 hrs to prepare a charge generation layer coating liquid. The charge generation layer coating liquid was coated on the three (3) aluminium drums with the undercoat layers prepared as above and the liquid coated on each drum was dried at 130° C. for 10 min to form a charge generation layer having a thickness of 0.2 μm thereon.

Preparation of a Charge Transport Layer Coating Liquid and a Coating Method Thereof The following materials were mixed to prepare a charge transport layer coating liquid.

| | |
|---|---|
| Charge transport material having the following formula (2): | 8 |
| Polycarbonate (Z-type having a viscosity-average molecular weight of 50,000) | 10 |
| Silicone oil (KF-50 from Shin-Etsu Chemical Co., Ltd.) | 0.002 |
| Tetrahydrofuran | 100 |

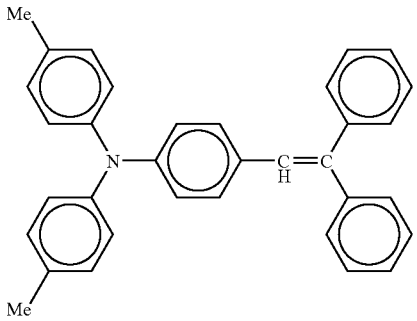

The charge transport layer coating liquid was coated on each charge generation layer formed as above, and the liquid was dried at 130° C. for 20 min to form a charge transport layer having a thickness of 30 μm thereon. Thus, photoreceptors of Example 1 was prepared.

Example 2

The procedure for preparation of the photoreceptors of Example 1 was repeated to prepare photoreceptors except for changing an amount of the diethylamine in the undercoat layer coating liquid from 0.23 to 0.0023 parts by weight.

Example 3

The procedure for preparation of the photoreceptors of Example 1 was repeated to prepare photoreceptors except for changing an amount of the diethylamine in the undercoat layer coating liquid from 0.23 to 1.15 parts by weight.

Example 4

The procedure for preparation of the photoreceptors of Example 1 was repeated to prepare photoreceptors except for changing an amount of the diethylamine in the undercoat layer coating liquid from 0.23 to 1.72 parts by weight.

Example 5

The procedure for preparation of the photoreceptors of Example 1 was repeated to prepare photoreceptors except for changing an amount of the diethylamine in the undercoat layer coating liquid from 0.23 to 0.000023 parts by weight.

Example 6

The procedure for preparation of the photoreceptors of Example 1 was repeated to prepare photoreceptors except for changing an amount of the diethylamine in the undercoat layer coating liquid from 0.23 to 0.000013 parts by weight.

Examples 7 to 12

The procedures for preparation of the photoreceptors of Examples 1 to 6 were repeated to prepare photoreceptors except for changing the diethylamine to triethylamine in the undercoat layer coating liquid.

Examples 13 to 18

The procedures for preparation of the photoreceptors of Examples 1 to 6 were repeated to prepare photoreceptors except for changing the diethylamine to ethyl ethanolamine in the undercoat layer coating liquid.

Examples 19 to 24

The procedures for preparation of the photoreceptors of Examples 1 to 6 were repeated to prepare photoreceptors except for changing the diethylamine to diethyl ethanolamine in the undercoat layer coating liquid.

Example 25

The procedure for preparation of the photoreceptors of Example 1 was repeated to prepare photoreceptors except for changing the undercoat layer coating liquid to an undercoat layer coating liquid having the following formula:

| | |
|---|---|
| Titanium oxide (CREL having a purity of 99.7% by weight from Ishihara Sangyo Kaisha, Ltd.) | 80 |
| Oil-free alkyd resin (Bekkolite M6401-50 having a solid content of 50% by weight and a hydroxyl value of 130 from Dainippon Ink &Chemicals, Inc.) | 25 |
| Blocked isocyanate resin (Burnock B7-887-50 having a solid content of 60% by weight from Dainippon Ink and Chemicals, Inc.) | 12.5 |
| Methyl ethyl ketone | 100 |
| Diethyl ethanolamine | 0.23 |

Example 26

The procedure for preparation of the photoreceptors of Example 25 was repeated to prepare photoreceptors except for changing an amount of the diethyl ethanolamine in the undercoat layer coating liquid from 0.23 to 0.0023 parts by weight.

Example 27

The procedure for preparation of the photoreceptors of Example 25 was repeated to prepare photoreceptors except for changing an amount of the diethyl ethanolamine in the undercoat layer coating liquid from 0.23 to 1.15 parts by weight.

Example 28

The procedure for preparation of the photoreceptors of Example 25 was repeated to prepare photoreceptors except for changing an amount of the diethyl ethanolamine in the undercoat layer coating liquid from 0.23 to 1.72 parts by weight.

Example 29

The procedure for preparation of the photoreceptors of Example 25 was repeated to prepare photoreceptors except for changing an amount of the diethyl ethanolamine in the undercoat layer coating liquid from 0.23 to 0.000023 parts by weight.

Example 30

The procedure for preparation of the photoreceptors of Example 25 was repeated to prepare photoreceptors except for changing an amount of the diethyl ethanolamine in the undercoat layer coating liquid from 0.23 to 0.000013 parts by weight.

Examples 31 to 36

The procedures for preparation of the photoreceptors of Examples 25 to 30 were repeated to prepare photoreceptors except for changing the diethyl ethanolamine to hexamethylene diamine in the undercoat layer coating liquid.

Examples 37 to 42

The procedures for preparation of the photoreceptors of Examples 25 to 30 were repeated to prepare photoreceptors except for changing the diethyl ethanolamine to methyl ethanolamine in the undercoat layer coating liquid.

Comparative Example 1

The procedure for preparation of the photoreceptors of Example 1 was repeated to prepare photoreceptors except for excluding the diethylamine in the undercoat layer coating liquid.

Comparative Example 2

The procedure for preparation of the photoreceptors of Example 1 was repeated to prepare photoreceptors except for changing the diethylamine to dibutyltinlaurate in the undercoat layer coating liquid.

Comparative Example 3

The procedure for preparation of the photoreceptors of Example 25 was repeated to prepare photoreceptors except for excluding the diethyl ethanolamine in the undercoat layer coating liquid.

Comparative Example 4

The procedure for preparation of the photoreceptors of Example 25 was repeated to prepare photoreceptors except for changing 0.23 parts by weight of the diethyl ethanolamine to 0.0002 parts by weight of octyltin.

Each of the thus prepared 3 photoreceptors in Examples 1 to 42 and Comparative Examples 1 to 4 was installed in Imagio MF2730 from Ricoh Company, Ltd. When −1,650 V bias was applied to the charging roller, the white part potential (Vw) and black part potential (VL) were measured. Then, 30,000 images of a chart having a black solid image of 5% were continuously produced. Besides the chart image, a white image and a 16-level halftone image were evaluated to find abnormal images, and a black part image density of the 16-level halftone image was evaluated. In addition, viscosities of the undercoat layer coating liquids were measured by E-type viscometer ELD from TOKIMEC INC. at 20° C.

The evaluation results are shown in Tables 1-1 and 1-2.

TABLE 1-1

| Example | Base resin | Blocked isocyanate | Basic amine | Content of basic amine (against resin) |
|---|---|---|---|---|
| Example 1 | M6163-60 | B3-867 | Diethylamine | 1.00% |
| 2 | M6163-60 | B3-867 | Diethylamine | 0.01% |
| 3 | M6163-60 | B3-867 | Diethylamine | 5.00% |

TABLE 1-1-continued

| Example | Base resin | Blocked isocyanate | Basic amine | Content of basic amine (against resin) |
|---|---|---|---|---|
| 4 | M6163-60 | B3-867 | Diethylamine | 7.50% |
| 5 | M6163-60 | B3-867 | Diethylamine | 0.0001% |
| 6 | M6163-60 | B3-867 | Diethylamine | 0.00005% |
| 7 | M6163-60 | B3-867 | Triethylamine | 1.00% |
| 8 | M6163-60 | B3-867 | Triethylamine | 0.01% |
| 9 | M6163-60 | B3-867 | Triethylamine | 5.00% |
| 10 | M6163-60 | B3-867 | Triethylamine | 7.50% |
| 11 | M6163-60 | B3-867 | Triethylamine | 0.0001% |
| 12 | M6163-60 | B3-867 | Triethylamine | 0.00005% |
| 13 | M6163-60 | B3-867 | Ethyl ethanolamine | 1.00% |
| 14 | M6163-60 | B3-867 | Ethyl ethanolamine | 0.01% |
| 15 | M6163-60 | B3-867 | Ethyl ethanolamine | 5.00% |
| 16 | M6163-60 | B3-867 | Ethyl ethanolamine | 7.50% |
| 17 | M6163-60 | B3-867 | Ethyl ethanolamine | 0.0001% |
| 18 | M6163-60 | B3-867 | Ethyl ethanolamine | 0.00005% |
| 19 | M6163-60 | B3-867 | Diethyl ethanolamine | 1.00% |
| 20 | M6163-60 | B3-867 | Diethyl ethanolamine | 0.01% |
| 21 | M6163-60 | B3-867 | Diethyl ethanolamine | 5.00% |
| 22 | M6163-60 | B3-867 | Diethyl ethanolamine | 7.50% |
| 23 | M6163-60 | B3-867 | Diethyl ethanolamine | 0.0001% |
| 24 | M6163-60 | B3-867 | Diethyl ethanolamine | 0.00005% |
| 25 | M6401-50 | B7-887-60 | Diethyl ethanolamine | 1.00% |
| 26 | M6401-50 | B7-887-60 | Diethyl ethanolamine | 0.01% |

TABLE 1-1-continued

| Example | Base resin | Blocked isocyanate | Basic amine | Content of basic amine (against resin) |
|---|---|---|---|---|
| 27 | M6401-50 | B7-887-60 | Diethyl ethanolamine | 5.00% |
| 28 | M6401-50 | B7-887-60 | Diethyl ethanolamine | 7.50% |
| 29 | M6401-50 | B7-887-60 | Diethyl ethanolamine | 0.0001% |
| 30 | M6401-50 | B7-887-60 | Diethyl ethanolamine | 0.00005% |
| 31 | M6401-50 | B7-887-60 | Hexamethylene diamine | 1.00% |
| 32 | M6401-50 | B7-887-60 | Hexamethylene diamine | 0.01% |
| 33 | M6401-50 | B7-887-60 | Hexamethylene diamine | 5.00% |
| 34 | M6401-50 | B7-887-60 | Hexamethylene diamine | 7.50% |
| 35 | M6401-50 | B7-887-60 | Hexamethylene diamine | 0.0001% |
| 36 | M6401-50 | B7-887-60 | Hexamethylene diamine | 0.00005% |
| 37 | M6401-50 | B7-887-60 | Methyl ethanolamine | 1.00% |
| 38 | M6401-50 | B7-887-60 | Methyl ethanolamine | 0.01% |
| 39 | M6401-50 | B7-887-60 | Methyl ethanolamine | 5.00% |
| 40 | M6401-50 | B7-887-60 | Methyl ethanolamine | 7.50% |
| 41 | M6401-50 | B7-887-60 | Methyl ethanolamine | 0.0001% |
| 42 | M6401-50 | B7-887-60 | Methyl ethanolamine | 0.00005% |
| Comparative Example 1 | M6163-60 | B3-867 | None | None |
| 2 | M6163-60 | B3-867 | Dibutyltin oxide | 1.00% |
| 3 | M6401-50 | B7-887-60 | None | None |
| 4 | M6401-50 | B7-887-60 | Octyltin | 0.0001% |

TABLE 1-2

| | Undercoat layer drying conditions | Initial potential Vw (−V) | Initial potential VL (=V) | Potential after 30,000 images Vw (−V) | Potential after 30,000 images VL (=V) | Abnormal images | Viscosity Soon after preparation (mPa · s) | Viscosity 1 month later (mPa · s) |
|---|---|---|---|---|---|---|---|---|
| Example 1 | 110° C. 20 min | 915 | 150 | 925 | 165 | Normal | 8.5 | 8.3 |
| | 130° C. 20 min | 905 | 150 | 930 | 165 | Normal | | |
| | 150° C. 20 min | 910 | 145 | 945 | 150 | Normal | | |
| 2 | 110° C. 20 min | 920 | 145 | 925 | 155 | Normal | 8.6 | 8.5 |
| | 130° C. 20 min | 925 | 150 | 920 | 150 | Normal | | |
| | 150° C. 20 min | 915 | 140 | 935 | 150 | Normal | | |
| 3 | 110° C. 20 min | 905 | 145 | 920 | 165 | Normal | 8.5 | 8.9 |
| | 130° C. 20 min | 895 | 150 | 920 | 165 | Normal | | |
| | 150° C. 20 min | 910 | 145 | 930 | 170 | Normal | | |
| 4 | 110° C. 20 min | 895 | 145 | 925 | 215 | Image density deteriorated after 27,000 images | 8.4 | 13.2 |
| | 130° C. 20 min | 905 | 145 | 925 | 220 | Image density deteriorated after 26,000 images | | |

TABLE 1-2-continued

| | Undercoat layer drying conditions | Initial potential Vw (−V) | Initial potential VL (=V) | Potential after 30,000 images Vw (−V) | Potential after 30,000 images VL (=V) | Abnormal images | Viscosity Soon after preparation (mPa · s) | Viscosity 1 month later (mPa · s) |
|---|---|---|---|---|---|---|---|---|
| | 150° C. 20 min | 925 | 140 | 945 | 215 | Image density deteriorated after 29,000 images | | |
| 5 | 110° C. 20 min | 915 | 150 | 930 | 185 | Normal | 8.3 | 8.6 |
| | 130° C. 20 min | 905 | 155 | 945 | 190 | Normal | | |
| | 150° C. 20 min | 910 | 145 | 925 | 185 | Normal | | |
| 6 | 110° C. 20 min | 920 | 260 | 920 | 300 | Image density deteriorated after 10,000 images | 9 | 8.4 |
| | 130° C. 20 min | 925 | 190 | 935 | 220 | Normal | | |
| | 150° C. 20 min | 900 | 145 | 920 | 160 | Normal | | |
| 7 | 110° C. 20 min | 910 | 145 | 925 | 165 | Normal | 8.6 | 9.5 |
| | 130° C. 20 min | 905 | 140 | 945 | 155 | Normal | | |
| | 150° C. 20 min | 915 | 145 | 925 | 160 | Normal | | |
| 8 | 110° C. 20 min | 905 | 150 | 945 | 170 | Normal | 8.8 | 9 |
| | 130° C. 20 min | 910 | 145 | 930 | 175 | Normal | | |
| | 150° C. 20 min | 905 | 140 | 945 | 165 | Normal | | |
| 9 | 110° C. 20 min | 895 | 145 | 925 | 165 | Normal | 8.5 | 9.5 |
| | 130° C. 20 min | 900 | 140 | 920 | 165 | Normal | | |
| | 150° C. 20 min | 890 | 130 | 935 | 160 | Normal | | |
| 10 | 110° C. 20 min | 910 | 150 | 920 | 230 | Image density deteriorated after 27,000 images | 8.7 | 12.5 |
| | 130° C. 20 min | 905 | 145 | 925 | 225 | Image density deteriorated after 26,000 images | | |
| | 150° C. 20 min | 915 | 150 | 945 | 225 | Image density deteriorated after 29,000 images | | |
| 11 | 110° C. 20 min | 905 | 190 | 930 | 230 | Image density deteriorated after 27,000 images | 8.5 | 9.2 |
| | 130° C. 20 min | 910 | 145 | 945 | 165 | Normal | | |
| | 150° C. 20 min | 895 | 140 | 925 | 165 | Normal | | |
| 12 | 110° C. 20 min | 900 | 205 | 920 | 245 | Image density deteriorated after 25,000 images | 8.9 | 9.5 |
| | 130° C. 20 min | 905 | 185 | 935 | 210 | Normal | | |
| | 150° C. 20 min | 900 | 150 | 910 | 150 | Normal | | |
| 13 | 110° C. 20 min | 905 | 135 | 905 | 165 | Normal | 8.3 | 8.7 |
| | 130° C. 20 min | 915 | 130 | 925 | 170 | Normal | | |
| | 150° C. 20 min | 895 | 135 | 905 | 165 | Normal | | |
| 14 | 110° C. 20 min | 900 | 140 | 925 | 165 | Normal | 8.5 | 9.5 |
| | 130° C. 20 min | 895 | 135 | 945 | 165 | Normal | | |
| | 150° C. 20 min | 905 | 130 | 925 | 170 | Normal | | |
| 15 | 110° C. 20 min | 905 | 135 | 945 | 165 | Normal | 8.7 | 9.2 |
| | 130° C. 20 min | 900 | 130 | 930 | 165 | Normal | | |
| | 150° C. 20 min | 895 | 120 | 945 | 160 | Normal | | |

TABLE 1-2-continued

| | Undercoat layer drying conditions | Initial potential Vw (−V) | Initial potential VL (=V) | Potential after 30,000 images Vw (−V) | Potential after 30,000 images VL (=V) | Abnormal images | Viscosity Soon after preparation (mPa · s) | Viscosity 1 month later (mPa · s) |
|---|---|---|---|---|---|---|---|---|
| 16 | 110° C. 20 min | 910 | 140 | 925 | 215 | Image density deteriorated after 29,000 images | 8.4 | 15.3 |
| | 130° C. 20 min | 915 | 135 | 920 | 225 | Normal | | |
| | 150° C. 20 min | 895 | 140 | 935 | 210 | Normal | | |
| 17 | 110° C. 20 min | 900 | 180 | 920 | 210 | Normal | 8.6 | 8.7 |
| | 130° C. 20 min | 905 | 135 | 925 | 165 | Normal | | |
| | 150° C. 20 min | 915 | 130 | 945 | 150 | Normal | | |
| 18 | 110° C. 20 min | 905 | 195 | 905 | 240 | Image density deteriorated after 24,000 images | 8.6 | 8.6 |
| | 130° C. 20 min | 895 | 175 | 925 | 210 | Normal | | |
| | 150° C. 20 min | 900 | 140 | 945 | 150 | Normal | | |
| 19 | 110° C. 20 min | 915 | 145 | 925 | 165 | Normal | 8.4 | 8.9 |
| | 130° C. 20 min | 920 | 140 | 945 | 160 | Normal | | |
| | 150° C. 20 min | 905 | 145 | 925 | 165 | Normal | | |
| 20 | 110° C. 20 min | 905 | 160 | 945 | 165 | Normal | 8.4 | 8.5 |
| | 130° C. 20 min | 915 | 165 | 915 | 170 | Normal | | |
| | 150° C. 20 min | 920 | 175 | 925 | 165 | Normal | | |
| 21 | 110° C. 20 min | 915 | 165 | 905 | 185 | Normal | 8.6 | 9.2 |
| | 130° C. 20 min | 905 | 155 | 905 | 195 | Normal | | |
| | 150° C. 20 min | 910 | 160 | 915 | 180 | Normal | | |
| 22 | 110° C. 20 min | 895 | 165 | 900 | 225 | Image density deteriorated after 23,000 images | 8.6 | 17.3 |
| | 130° C. 20 min | 915 | 155 | 905 | 210 | Image density deteriorated after 25,000 images | | |
| | 150° C. 20 min | 895 | 160 | 895 | 215 | Image density deteriorated after 25,000 images | | |
| 23 | 110° C. 20 min | 900 | 145 | 900 | 165 | Normal | 8.4 | 9 |
| | 130° C. 20 min | 915 | 140 | 910 | 165 | Normal | | |
| | 150° C. 20 min | 905 | 145 | 915 | 170 | Normal | | |
| 24 | 110° C. 20 min | 905 | 200 | 905 | 280 | Image density deteriorated after 21,000 images | 8.5 | 9.2 |
| | 130° C. 20 min | 895 | 175 | 900 | 210 | Image density deteriorated after 24,000 images | | |
| | 150° C. 20 min | 900 | 140 | 910 | 175 | Normal | | |
| 25 | 110° C. 20 min | 915 | 145 | 930 | 165 | Normal | 8.5 | 8.7 |
| | 130° C. 20 min | 905 | 140 | 920 | 165 | Normal | | |
| | 150° C. 20 min | 905 | 145 | 920 | 170 | Normal | | |
| 26 | 110° C. 20 min | 910 | 155 | 925 | 165 | Normal | 8.5 | 9.3 |
| | 130° C. 20 min | 895 | 145 | 910 | 165 | Normal | | |
| | 150° C. 20 min | 900 | 140 | 915 | 160 | Normal | | |

TABLE 1-2-continued

| | Undercoat layer drying conditions | Initial potential Vw (−V) | Initial potential VL (=V) | Potential after 30,000 images Vw (−V) | Potential after 30,000 images VL (=V) | Abnormal images | Viscosity Soon after preparation (mPa · s) | Viscosity 1 month later (mPa · s) |
|---|---|---|---|---|---|---|---|---|
| 27 | 110° C. 20 min | 905 | 150 | 920 | 165 | Normal | 8.4 | 9.3 |
| | 130° C. 20 min | 900 | 150 | 915 | 165 | Normal | | |
| | 150° C. 20 min | 905 | 145 | 920 | 170 | Normal | | |
| 28 | 110° C. 20 min | 905 | 150 | 920 | 235 | Image density deteriorated after 26,000 images | 8.3 | 13.5 |
| | 130° C. 20 min | 915 | 145 | 930 | 240 | Image density deteriorated after 25,000 images | | |
| | 150° C. 20 min | 905 | 155 | 920 | 235 | Image density deteriorated after 25,000 images | | |
| 29 | 110° C. 20 min | 895 | 145 | 920 | 170 | Normal | 9 | 9.1 |
| | 130° C. 20 min | 900 | 155 | 925 | 165 | Normal | | |
| | 150° C. 20 min | 915 | 150 | 940 | 170 | Normal | | |
| 30 | 110° C. 20 min | 905 | 200 | 930 | 260 | Image density deteriorated after 20,000 images | 9 | 9 |
| | 130° C. 20 min | 920 | 175 | 945 | 220 | Image density deteriorated after 24,000 images | | |
| | 150° C. 20 min | 900 | 155 | 925 | 175 | Normal | | |
| 31 | 110° C. 20 min | 915 | 135 | 940 | 165 | Normal | 8.8 | 8.9 |
| | 130° C. 20 min | 905 | 130 | 930 | 155 | Normal | | |
| | 150° C. 20 min | 905 | 135 | 930 | 145 | Normal | | |
| 32 | 110° C. 20 min | 910 | 145 | 935 | 155 | Normal | 8.5 | 8.7 |
| | 130° C. 20 min | 895 | 135 | 920 | 145 | Normal | | |
| | 150° C. 20 min | 900 | 130 | 925 | 165 | Normal | | |
| 33 | 110° C. 20 min | 905 | 140 | 930 | 190 | Normal | 8.3 | 9.7 |
| | 130° C. 20 min | 900 | 140 | 925 | 185 | Normal | | |
| | 150° C. 20 min | 905 | 135 | 930 | 185 | Normal | | |
| 34 | 110° C. 20 min | 905 | 140 | 930 | 225 | Image density deteriorated after 24,000 images | 8.5 | 15.2 |
| | 130° C. 20 min | 915 | 135 | 940 | 235 | Image density deteriorated after 23,000 images | | |
| | 150° C. 20 min | 905 | 145 | 930 | 230 | Image density deteriorated after 24,000 images | | |
| 35 | 110° C. 20 min | 915 | 135 | 940 | 190 | Normal | 8.7 | 8.9 |
| | 130° C. 20 min | 905 | 145 | 930 | 150 | Normal | | |
| | 150° C. 20 min | 910 | 140 | 935 | 155 | Normal | | |
| 36 | 110° C. 20 min | 920 | 190 | 945 | 270 | Image density | 8.5 | 9 |

TABLE 1-2-continued

| | Undercoat layer drying conditions | Initial potential Vw (−V) | Initial potential VL (=V) | Potential after 30,000 images Vw (−V) | Potential after 30,000 images VL (=V) | Abnormal images | Viscosity Soon after preparation (mPa · s) | Viscosity 1 month later (mPa · s) |
|---|---|---|---|---|---|---|---|---|
| | | | | | | deteriorated after 19,000 images | | |
| | 130° C. 20 min | 925 | 165 | 935 | 220 | Image density deteriorated after 27,000 images | | |
| | 150° C. 20 min | 915 | 145 | 925 | 170 | Normal | | |
| 37 | 110° C. 20 min | 905 | 145 | 915 | 150 | Normal | 8.9 | 8.5 |
| | 130° C. 20 min | 895 | 140 | 905 | 160 | Normal | | |
| | 150° C. 20 min | 910 | 145 | 920 | 150 | Normal | | |
| 38 | 110° C. 20 min | 895 | 155 | 905 | 170 | Normal | 8.4 | 8.9 |
| | 130° C. 20 min | 905 | 145 | 915 | 195 | Normal | | |
| | 150° C. 20 min | 905 | 140 | 915 | 190 | Normal | | |
| 39 | 110° C. 20 min | 915 | 150 | 925 | 190 | Normal | 8.5 | 9.5 |
| | 130° C. 20 min | 800 | 150 | 900 | 185 | Normal | | |
| | 150° C. 20 min | 895 | 145 | 905 | 185 | Normal | | |
| 40 | 110° C. 20 min | 915 | 150 | 925 | 230 | Image density deteriorated after 22,000 images | 8.3 | 14.3 |
| | 130° C. 20 min | 905 | 150 | 915 | 235 | Image density deteriorated after 23,000 images | | |
| | 150° C. 20 min | 900 | 145 | 910 | 230 | Image density deteriorated after 21,000 images | | |
| 41 | 110° C. 20 min | 920 | 125 | 930 | 175 | Normal | 8.8 | 9.3 |
| | 130° C. 20 min | 915 | 135 | 925 | 165 | Normal | | |
| | 150° C. 20 min | 920 | 130 | 930 | 170 | Normal | | |
| 42 | 110° C. 20 min | 895 | 180 | 905 | 220 | Image density deteriorated after 29,000 images | 8.5 | 9 |
| | 130° C. 20 min | 900 | 155 | 910 | 190 | Normal | | |
| | 150° C. 20 min | 905 | 135 | 915 | 170 | Normal | | |
| Comparative Example 1 | 110° C. 20 min | 900 | 350 | 970 | 470 | Images flowed from the beginning. Black part image density deteriorated. Black part almost disappeared after 20,000 images | 8.5 | 9.2 |

TABLE 1-2-continued

| | Undercoat layer drying conditions | Initial potential Vw (−V) | Initial potential VL (=V) | Potential after 30,000 images Vw (−V) | Potential after 30,000 images VL (=V) | Abnormal images | Viscosity Soon after preparation (mPa · s) | Viscosity 1 month later (mPa · s) |
|---|---|---|---|---|---|---|---|---|
| | 130° C. 20 min | 905 | 210 | 960 | 320 | Images flowed, black part Image density deteriorated after 15,000 images | | |
| | 150° C. 20 min | 895 | 140 | 950 | 190 | Normal | | |
| 2 | 110° C. 20 min | 900 | 220 | 950 | 250 | Local black spots after 21,000 images | 7.9 | 8.5 |
| | 130° C. 20 min | 905 | 185 | 935 | 210 | Local black spots after 12,000 images | | |
| | 150° C. 20 min | 905 | 195 | 920 | 225 | Local black spots after 8,000 images | | |
| 3 | 110° C. 20 min | 900 | 290 | 955 | 390 | Images flowed, black part Image density deteriorated after 12,000 images | 8.4 | 8.9 |
| | 130° C. 20 min | 920 | 200 | 945 | 310 | Images flowed, black part Image density deteriorated after 18,000 images | | |
| | 150° C. 20 min | 900 | 145 | 940 | 180 | Normal | | |
| 4 | 110° C. 20 min | 900 | 235 | 950 | 280 | Local black spots after 26,000 images | 8.4 | 8.9 |
| | 130° C. 20 min | 920 | 200 | 945 | 230 | Local black spots after 15,000 images | | |
| | 150° C. 20 min | 900 | 150 | 945 | 180 | Local black spots after 12,000 images | | |

This application claims priority and contains subject matter related to Japanese Patent Application No. 2003-407365 filed on Dec. 5, 2003, the entire contents of which are hereby incorporated by reference.

Having now fully described the invention, it will be apparent to one of ordinary skill in the art that many changes and modifications can be made thereto without departing from the spirit and scope of the invention as set forth therein.

What is claimed as new and desired to be secured by Letters Patent of the United States is:

1. An electrophotographic photoreceptor, comprising:

an electroconductive substrate;

an undercoat layer located overlying the electroconductive substrate; and a photosensitive layer located overlying the undercoat layer, wherein the undercoat layer comprises a crosslinked reaction product of a blocked isocyanate compound, an oil-free alkyd resin including a hydroxyl group, and a basic amine; and the amount of basic amine is from 0.0001 to 5% by weight based on total weight of the oil-free alkyd resin and blocked isocyanate compound;

wherein the basic amine is one selected from the group consisting of ammonia, monoethanol amine, diethanol amine, triethanol amine, diethyl ethanolamine, methyl ethanolamine, ethylene diamine, diamino butane, diamino propane, hexane diamine dodecane diamine, diethylene triamine, triethylene tetramine and polyether diamine.

2. The electrophotographic photoreceptor of claim 1, wherein the electroconductive substrate comprises a material having a volume resistance not greater than $10^{10}\Omega\cdot$cm.

3. The electrophotographic photoreceptor of claim 1, wherein the oil-free alkyd resin including a hydroxyl group is a saturated polyester resin formed of direct ester bonds of a polybasic acid and a polyalcohol, with no fatty acid.

4. The electrophotographic photoreceptor of claim 3, wherein the oil-free alkyd resin including a hydroxyl group has a hydroxyl value not less than 60 and not greater than 150.

5. The electrophotographic photoreceptor of claim 1, wherein the basic amine is diethyl ethanolamine or methyl ethanolamine.

6. The electrophotographic photoreceptor of claim 1, wherein the amount of basic amine is 0.01 to 1% by weight.

7. The electrophotographic photoreceptor of claim 1, wherein a number of moles of hydroxyl groups of the oil-free alkyd resin including a hydroxyl group is equal to the number of moles of isocyanate groups of the blocked isocyanate resin.

8. An image forming apparatus, comprising:

the electrophotographic photoreceptor according to claim 1;

a charger configured to charge the electrophotographic photoreceptor;

an irradiator configured to irradiate the electrophotographic photoreceptor to form an electrostatic latent image thereon;

an image developer configured to develop the electrostatic latent image with a toner to form a toner image thereon;

a transferer configured to transfer the toner image onto a receiving material;

a fixer configured to fix the toner image on the receiving material;

a cleaner configured to remove the toner remaining on the electrophotographic photoreceptor after transferred; and a discharger configured to discharge the electrophotographic photoreceptor.

9. A process cartridge, comprising:

the electrophotographic photoreceptor according to claim 1; and at least one selected from the group consisting of a charger, an irradiator, an image developer, a transferer and a fixer.

* * * * *